US007663563B2

(12) United States Patent
Kagaya et al.

(10) Patent No.: US 7,663,563 B2
(45) Date of Patent: Feb. 16, 2010

(54) HIGH FREQUENCY WAVE GLASS ANTENNA FOR AN AUTOMOBILE AND WINDOW GLASS SHEET FOR AN AUTOMOBILE WITH THE SAME

(75) Inventors: Osamu Kagaya, Chiyoda-ku (JP); Kiyoshi Oshima, Chiyoda-ku (JP); Koji Ikawa, Chiyoda-ku (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 12/046,050

(22) Filed: Mar. 11, 2008

(65) Prior Publication Data

US 2008/0246673 A1 Oct. 9, 2008

(30) Foreign Application Priority Data

Apr. 4, 2007 (JP) ..... 2007-098783
Sep. 6, 2007 (JP) ..... 2007-231401

(51) Int. Cl.
*H01Q 1/32* (2006.01)

(52) U.S. Cl. ..... 343/713

(58) Field of Classification Search ..... 343/711, 343/713

See application file for complete search history.

(56) References Cited

U.S. PATENT DOCUMENTS 4,527,164 A * 7/1985 Cestaro et al. ..... 343/713
5,719,585 A * 2/1998 Tabata et al. ..... 343/713
7,242,357 B2 * 7/2007 Fujii et al. ..... 343/713
7,289,075 B2 10/2007 Kagaya et al.
7,482,988 B2 * 1/2009 Sugimoto et al. ..... 343/713
2007/0080876 A1 4/2007 Kagaya et al.
2007/0247379 A1 10/2007 Oshima et al.

FOREIGN PATENT DOCUMENTS

JP 2006-25452 1/2006

OTHER PUBLICATIONS

U.S. Appl. No. 12/413,709, filed Mar. 30, 2009, Kagaya, et al.

* cited by examiner

*Primary Examiner*—Hoang V Nguyen
(74) *Attorney, Agent, or Firm*—Oblon, Spivak, McClelland, Maier & Neustadt, L.L.P.

(57) ABSTRACT

A high frequency wave glass antenna for an automobile includes an antenna conductor adapted to be disposed in or on an automobile window glass sheet, the antenna conductor being formed in such a loop shape that a portion of the loop shape is cut out by a length to dispose a discontinuity, both ends of the discontinuity or portions of the antenna conductor close to the discontinuity serving as feeding points, and a portion of the antenna conductor with the discontinuity disposed therein or a portion of the antenna conductor close to the discontinuity having a conductor width of 8.0 to 40 mm.

25 Claims, 11 Drawing Sheets

HIGH FREQUENCY WAVE GLASS ANTENNA FOR AN AUTOMOBILE AND WINDOW GLASS SHEET FOR AN AUTOMOBILE WITH THE SAME

BACKGROUND OF THE INVENTION

1. Field of the Invention

The present invention relates to a high frequency wave glass antenna for an automobile, which is appropriate to receive a digital terrestrial television broadcast in Japan (470 to 770 MHz), a UHF band analog television broadcast in Japan (470 to 770 MHz), or a US digital television broadcast (698 to 806 MHz). The present invention also relates to a window glass sheet for an automobile with the high frequency wave glass antenna.

2. Discussion of Background

Referring to FIG. 20, as a high frequency wave glass antenna for an automobile in use for receiving a digital terrestrial television broadcast in Japan, there has been used one that comprises a loop-shaped element 30 on a window glass sheet and a feeding point 31 disposed to the loop-shaped element 30 as disclosed in, e.g. JP-A-2006-25452.

This prior art antenna is a ground antenna, which needs to have a grounded element for connection therewith. The grounded element needs to be coupled with a metal member of a vehicle body in terms of alternating current. The prior art antenna has a complicated structure as a whole, which causes a problem in that it is not easy to mount the antenna.

In a case where an antenna including one or plural antenna conductors is used as a high frequency wave glass antenna for an automobile in use for receiving a digital terrestrial television broadcast in Japan, when an attempt is made to dispose a feeding point to a lateral portion of the antenna and to extend a feeder in a horizontal direction to fix the feeder to a portion of a vehicle body located in the horizontal direction seen from the antenna, there has been a problem in that it is difficult to receive a horizontally polarized wave.

SUMMARY OF THE INVENTION

It is an object of the present invention to solve the above-mentioned problem of the prior art and to provide a high frequency wave glass antenna for an automobile and a window glass sheet for an automobile with the high frequency wave glass antenna.

The present invention provides a high frequency wave glass antenna for an automobile, comprising an antenna conductor adapted to be disposed in or on an automobile window glass sheet, the antenna conductor being formed in such a loop shape that a portion of the loop shape is cut out by a length to dispose a discontinuity; both ends of the discontinuity or portions of the antenna conductor close to the discontinuity serving as feeding points; and a portion of the antenna conductor with the discontinuity disposed therein or a portion of the antenna conductor close to the discontinuity having a conductor width of 8.0 to 40 mm.

It is preferred that the discontinuity have a shortest gap of 0.5 to 20 mm.

It is preferred that the antenna conductor be configured to have such a shape and dimensions to be adapted to receive a digital television broadcast.

The present invention is effective in a reduction in return loss since the portion of the antenna conductor with the discontinuity disposed therein or a portion of the antenna conductor close to the discontinuity has a conductor width of 8.0 to 40 mm. When a cable or a connector is connected to the portion of the antenna conductor with the discontinuity disposed therein or the portions of the antenna conductor close to the discontinuity, the present invention has an advantage of being excellent in reliability since these portions have an enough width to make it difficult to peel out of the window glass sheet and to make the connection with the cable or connector reliable.

The high frequency way glass antenna for an automobile according to the present invention is small and is capable of receiving signals with a high antenna gain without damaging the sight through an automobile window glass sheet and appearance even if a desired broadcast frequency is in a wide range of broadcast frequency band, such as a digital terrestrial television broadcast in Japan, a UHF band analogue television broadcast in Japan or a U.S. digital broadcast.

It is easy to mount the glass antenna according to the present invention since the glass antenna has a simple structure as a whole. The glass antenna according to the present invention is optimal as a high frequency wave glass antenna for the rear window of an automobile since it is possible to obtain a high antenna gain even if the glass antenna is disposed at a lower area of the rear window including a defogger.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
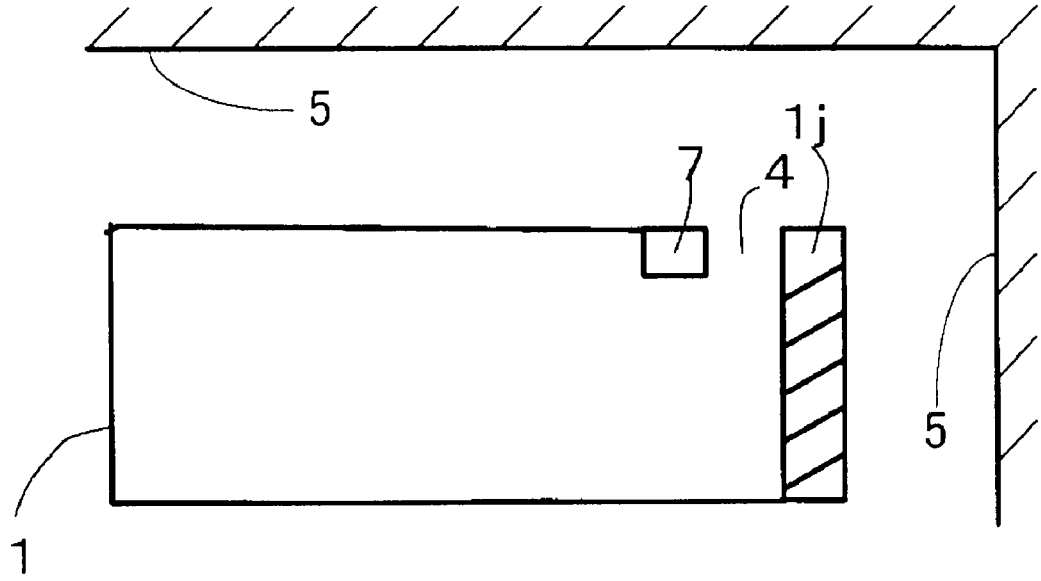
FIG. 1 is a plan view showing the high frequency wave glass antenna for an automobile according to an embodiment of the present invention.

Now, the planar antenna according to the present invention will be described in detail based on preferred embodiments, which are shown in the accompanying drawings. FIG. 1 is a plan view showing the high frequency wave glass antenna for an automobile according to an embodiment of the present invention, which is seen from one of both surfaces of a window glass sheet with the high frequency wave glass antenna disposed thereon or therein. In the explanation of FIG. 1 and the views showing the embodiments stated later, the directions are referred to, based on the directions on the accompanying is drawings, unless otherwise specified. Each of FIG. 1 and FIGS. 2 to 12 stated later is a view seen from a car-interior side or a car-exterior-side of the window glass sheet. In the following explanation, the embodiments will be described about a case where the antenna is appropriate for a digital terrestrial television broadcast in Japan.

In the embodiment shown in FIG. 1, reference symbol 1 designates a loop-shaped antenna conductor, which has a discontinuity 4 disposed between an upper side and a right lateral side 1*j* as one of both lateral sides. The upper side has a feeding point 7 disposed at a right lateral end thereof so that the right lateral side 1*j* serves as a feeding point to be paired with the feeding point 7. In this embodiment, it is preferred in terms of mounting that a portion of the right lateral side 1*j* close to the feeding point 7 serve as another feeding point. Although not shown, the feeding structure according to an embodiment different from the embodiment shown in FIG. 1 will be described. In this different embodiment, the discontinuity is disposed between a lower side and the right lateral side 1*j* as one of both lateral sides of the loop-shaped antenna conductor, and the right lateral side 1*j* serves as a feeding point to be paired with the feeding point disposed to the lower side. In this different embodiment as well, it is preferred in terms of mounting that a portion of the right lateral side 1*j* close to the feeding point disposed to the lower side serve as another feeding point. In the embodiment shown in FIG. 1, the feeding point is disposed at a corner of the loop-shaped conductor or a portion thereof close to the corner. In FIG. 1, reference symbol 5 designates an edge of the vehicle opening for a window glass sheet with the antenna disposed thereon or therein. The edge of the vehicle opening is a peripheral edge of an opening of the vehicle body, into which the window glass sheet with the antenna disposed thereon or therein is fitted, and which serves as vehicle grounding and is made of a conductive material, such as metal.

Figure 2:
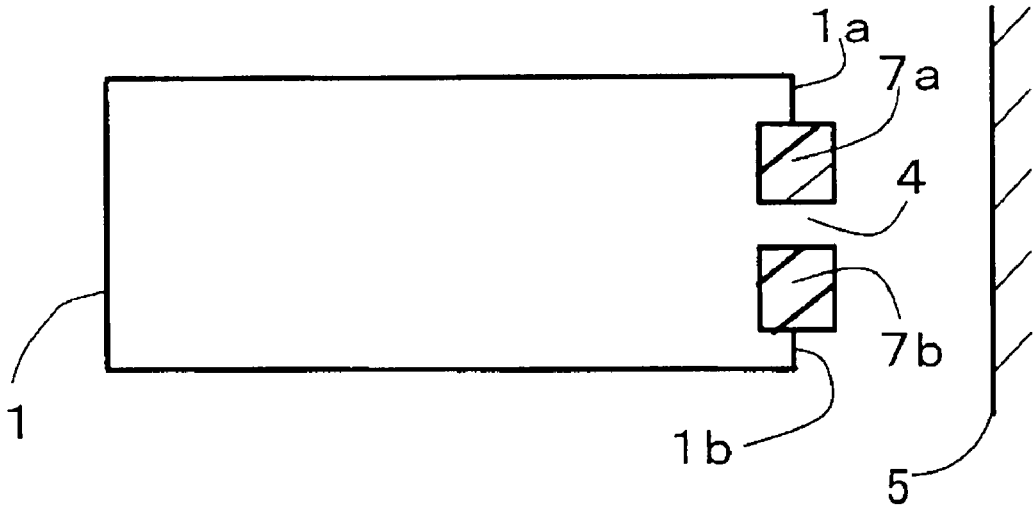
FIG. 2 is a plan view showing a feeding structure different from the one shown in FIG. 1.

In FIG. 2 is shown the feeding structure according to an embodiment different from the one shown in FIG. 1. In the embodiment shown in FIG. 2, the right lateral side includes an upper portion 1*a* close to a discontinuity 4 and a lower portion 1*b* close to the discontinuity 4, which have a greater width than the remaining portions of the right lateral side and serve as a feeding point 7*a* and a feeding point 7*b*, respectively.

In the present invention, the antenna conductor 1, which includes the discontinuity 4 configured as if the discontinuity is disposed by being cutting out of a portion of a loop-shaped conductor by a certain length, is disposed on or in a window glass sheet, and both ends of the discontinuity 4 or portions of the lateral side close to both ends serve as feeding points, respectively. At least one of a portion of the antenna conductor 1 with the discontinuity disposed therein or a portion of the antenna conductor 1 close to the discontinuity has a conductor width of 8.0 to 40 mm.

When the conductor width is 8.0 mm or more, it is advantageously possible to have better impedance matching and low return loss in comparison with a conductor width of less than 8.0 mm. It is preferred in terms of reliability and ease in mounting that a cable or connector is connected to such a portion of the antenna conductor 1 with the discontinuity disposed therein or such a portion of the antenna conductor 1 close to the discontinuity. Such a portion of the antenna conductor 1 with the discontinuity disposed therein or such a portion of the antenna conductor 1 close to the discontinuity is unlikely to peel out of the window glass sheet even if a vibration is given. When the conductor width is 40 mm or less, it is advantageously possible to make the antenna smaller, make the mounting of the antenna easier, ensure a better sight and have a better appearance in comparison with a conductor width of greater than 40 mm. The ranges of the conductor width are listed in the order of having better performance in Table 1 (the range having a greater number in Table 1 offers a better performance than the range having a smaller number).

TABLE 1

| Number | Range of Conductor Width (mm) |
|---|---|
| 1 | 8.0 to 40 |
| 2 | 10 to 40 |
| 3 | 12 to 35 |
| 4 | 15 to 30 |
| 5 | 17 to 25 |

In the present invention, the loop shape that would be originally formed by the antenna conductor 1 when it is assumed that no discontinuity 4 is disposed may be circular, substantially circular, oval, substantially oval, triangular, substantially triangular, square, substantially square, polygonal or substantially polygonal. There is no particular limitation to the loop shape that would be originally formed by the antenna conductor 4 when it is assumed that no discontinuity 4 is disposed. Among the above-mentioned shapes, it is preferred in terms of antenna performance, ease in mounting, ensuring sight and good appearance that the loop shape be a quadrangular or substantially quadrangular shape extending in a longitudinal direction. In the following explanation, the loop shape that would be originally formed by the antenna conductor 4 when it is assumed that no discontinuity 4 is disposed will be called the original loop shape.

In a case where the original loop shape is a triangular, substantially triangular, quadrangular, substantially quadrangular, polygonal or substantially polygonal shape, when one of the sides of the loop shape is called a first side, it is preferred that the discontinuity 4 be disposed in the first side, one of the corners of both ends of the first side therebetween, or a side close to the one corner and that the first side have a conductor width of 8.0 to 40 mm.

In a case where the original loop shape is a quadrangle or substantially quadrangle shape, where one of the sides of the loop shape is called a first side, and where the remaining sides are respectively called a second side, a third side and a fourth side in a clockwise direction, when the first side has the same length as the third side in terms of inner peripheral edge, the length is called $L_{W1}$. When the first side has a different length from the third side in terms of inner peripheral edge, a greater length is called $L_{W1}$. When the second side has the same length as the fourth side in terms of inner peripheral edge, the length is called $L_{W2}$. When the second side has a different length from the fourth side in terms of inner peripheral edge, a greater length is called $L_{W2}$. Under the above-mentioned conditions, it is preferred that $(L_{W2}/L_{W1})$ be 9 or less and that the first side and the third side have a shortest distance of 0.2 mm or above therebetween.

When $(L_{W2}/L_{W1})$ is 9 or less, it is possible to be low return loss in comparison with a case where $(L_{W2}/L_{W1})$ is beyond 9. When the first side and the third side have a shortest distance of 0.2 mm or more therebetween, it is possible to more easily manufacture the antenna, and more difficult for migration to occur in the metal contained in the antenna 1 and make it difficult for the first side and the third side to be short-circuited in comparison with a case where the first side and the third side have a shortest distance of shorter than 0.2 mm therebetween. When attention is given only to a low return loss, $(L_{W2}/L_{W1})$ preferably ranges from 0.5 to 5, more preferably ranges from 0.5 to 3 and most preferably ranges from 0.8 to 2.

In a case where it is assumed that a radio wave for communication has a wavelength of $\lambda_0$ in the air and that glass has a shortening coefficient of wavelength of k, when the formula of $\lambda_g=\lambda_0 \cdot k$ is established, it is preferred that a loop shape that is originally formed by the antenna conductor when it is assumed that no discontinuity is disposed have an inner peripheral edge having a length of $0.79\lambda_g$ to $2.50\lambda_g$.

It is preferred in terms of ease in mounting, good appearance and ensuring sight that the original loop shape be a quadrangular or substantially quadrangular shape extending in the longitudinal direction. In this case, when two shorter sides of the four sides of the loop shape are called lateral sides, it is preferred that the discontinuity 4 be disposed in one of the two lateral sides, at a corner of the loop shape or a side of the loop shape close to the corner. The lateral side of the loop shape with the discontinuity 4 disposed therein, or the lateral side of the loop shape close to the discontinuity serves as a first side, and the remaining sides serve as a second side, a third side and a fourth side in the clockwise direction.

When the four sides of the loop shape contain only one longest side, it is preferred in terms of improving the antenna gain for a horizontally polarized wave, improving the return loss for the horizontally polarized wave and ease in mounting that the antenna conductor 1 be disposed so that a smaller one of the angles included between the longitudinal direction of the inner peripheral edge of the longest side and the horizontal surface has an absolute value of 0 to 30 degrees. In a case where the four sides of the loop shape contain two longest sides, when one of the longest sides is disposed in a lower position and called a lower side, it is preferred for the same reasons that the antenna conductor 1 be disposed so that a smaller one of the angles included between the longitudinal direction of the inner peripheral edge of the lower side and the horizontal surface has an absolute value of 0 to 30 degrees.

Figure 3:
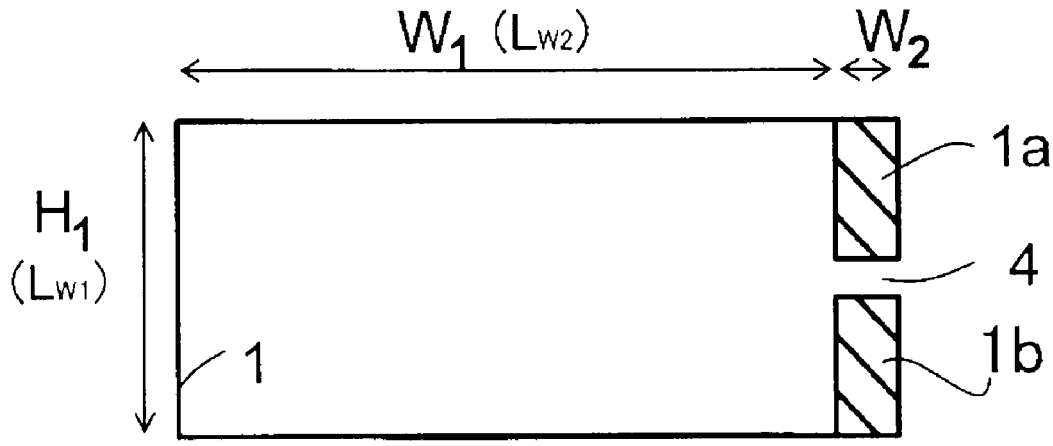
FIG. 3 is a plan view showing the antenna in Example 1 with the dimensional relationship of a maximum vertical width $H_1$ and a maximum transverse width $W_1$ shown therein.
Figure 4:
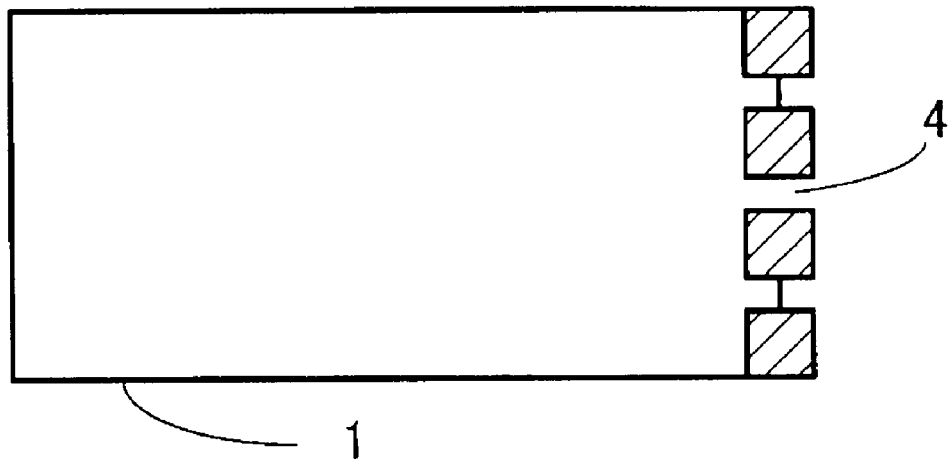
FIG. 4 is a plan view showing an embodiment wherein 70% or more of the length of a first side except for a discontinuity has a conductor width of 8.0 to 40 mm.
Figure 9:
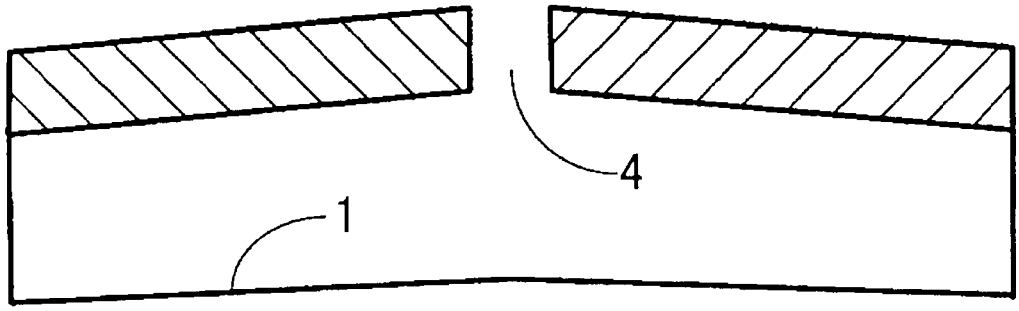
FIG. 9 is a plan view showing another embodiment different from the embodiment shown in FIG. 8, wherein at least one of the plural sides of a loop shape contains a curved line.

When adopting such embodiments, it is preferred in terms of ease in mounting, improving the appearance and ensuring sight that the dimensional relationship of the maximum vertical width $H_1$ and the maximum transverse width $W_1$ of the shape formed by the inner peripheral edge of the antenna conductor 1, i.e. $(W_1/H_1)$ be 1.2 to 9. $(W_1/H_1)$ more preferably ranges from 1.3 to 6 and most preferably from 1.5 to 4. It should be noted that $W_1$ corresponds to $L_{W2}$, and $H_1$ corresponds to $L_{W1}$. FIG. 3 shows an example in such embodiments. In FIG. 3 and FIGS. 4 and 9 stated later, the edge of the vehicle opening for a window glass sheet is omitted for simplicity.

In a case where two shorter sides of the four sides of the loop shape are called lateral sides, when the discontinuity 4 is disposed in one of the two lateral sides, at a corner of the loop shape or a side of the loop shape close to the corner, the lateral side with the discontinuity 4 disposed therein or the lateral side close to the discontinuity 4 has a conductor width of 8.0 to 40 mm.

When the conductor width is 8.0 mm or more, it is advantageously possible to have better impedance matching and low return loss in comparison with a conductor width of less than 8.0 mm. It is preferred in terms of reliability and ease in mounting that a cable or connector is connected to a portion of the antenna conductor 1 with the discontinuity disposed therein or a portion of the antenna conductor 1 close to the discontinuity. Such a portion of the antenna conductor 1 with the discontinuity disposed therein or such a portion of the antenna conductor 1 close to the discontinuity is unlikely to peel out of the window glass sheet even if a vibration is given. When the conductor width is 40 mm or less, it is advantageously possible to make the antenna smaller, make the mounting of the antenna easier, ensure a better sight and have a better appearance in comparison with a conductor width of greater than 40 mm. The ranges of the conductor width are listed in the order of having better performance in Table 1 (the range having a greater number in Table 1 offers a better performance than the range having a smaller number).

When the discontinuity 4 is configured as if the discontinuity is disposed by being cut out of a portion of the first side, it is preferred that 70% or more, in particular 80% or more, of the length of the first side except for the discontinuity 4 have a conductor width of 8.0 to 40 mm. The above-mentioned range "70% or more" has been determined, taking tolerance into account, since it is possible to improve return loss even if only a portion of the first side has a conductor width within the above-mentioned range "8.0 to 40 mm". An example of this embodiment is shown in FIG. 4.

When the discontinuity 4 is configured as if the discontinuity is disposed without being cut out of a portion of the first side, it is preferred for the same reason that 70% or above, in particular 80% or above, of the length of the first side have a conductor width of 8.0 to 40 mm.

When the original loop shape is formed in any other shape than a polygonal or substantially polygonal shape, it is preferred that a portion of the antenna conductor 1 except for a discontinuity-forming portion with the discontinuity 4 disposed therein and a discontinuity-adjacent portion close to the discontinuity have a conductor width of 0.2 to 40 mm. When the original loop shape is formed in a polygonal or substantially polygonal shape, it is preferred that at least one of the other sides than the first side have a conductor width of 0.2 to 40 mm. When such an embodiment is adopted to set the conductor width at 0.2 mm or more, it is advantageously possible to improve productivity in comparison with a conductor width of less than 0.2 mm. When the conductor width is 40 mm or less, it is advantageously possible to ensure sight and to improve appearance in comparison with a conductor width of wider than 40 mm. The conductor width preferably ranges from 0.4 to 35 mm, more preferably ranges from 0.4 to 10 mm, and most preferably ranges from 0.4 to 1.2 mm.

Figure 5:
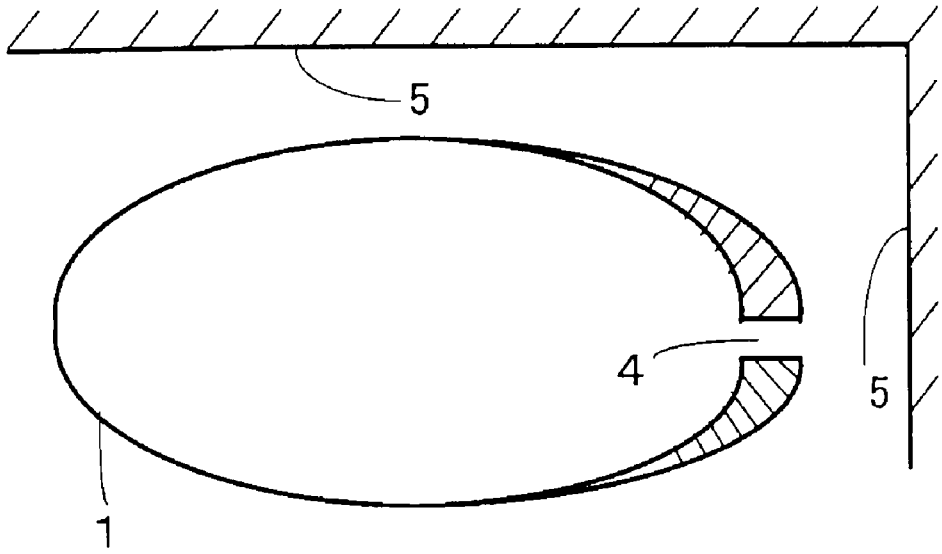
FIG. 5 is a plan view showing an embodiment wherein an original loop shape is an oval or substantially oval shape.
Figure 6:
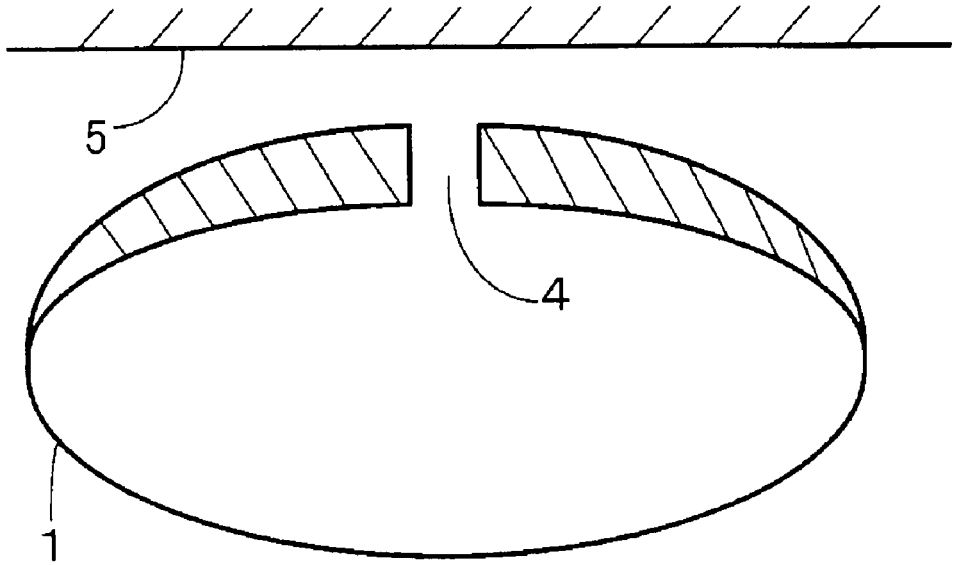
FIG. 6 is a plan view showing another embodiment different from the embodiment shown in FIG. 5, wherein an original loop shape is an oval or substantially oval is shape.

Each of FIGS. 5 and 6 shows an embodiment wherein the original loop shape is an oval or substantially oval shape. In the embodiment shown in FIG. 5, the discontinuity 4 is disposed at the intersection between the major axis and an arc of the oval or substantially oval shape or at a position close to the intersection. In the embodiment shown in FIG. 6, the discontinuity 4 is disposed at the intersection between the minor axis and an arc of the oval or substantially oval shape or at a position close to the intersection.

Figure 7:
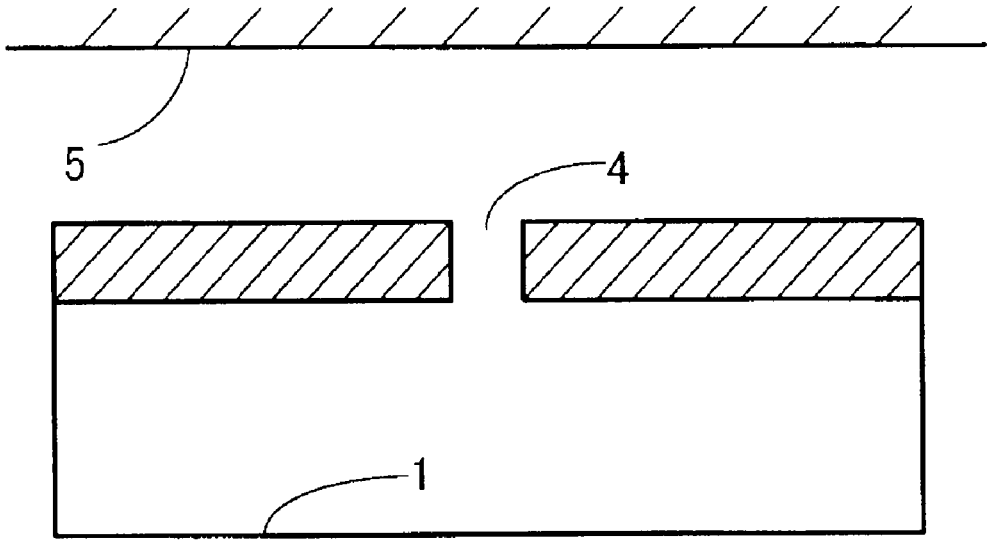
FIG. 7 is a plan view showing an embodiment wherein $(L_{W2}/L_{W1})$ is 1 or less.

FIG. 7 shows an embodiment wherein the original loop shape is a rectangular or substantially rectangular shape having a longer side serving as the first side.

Figure 8:
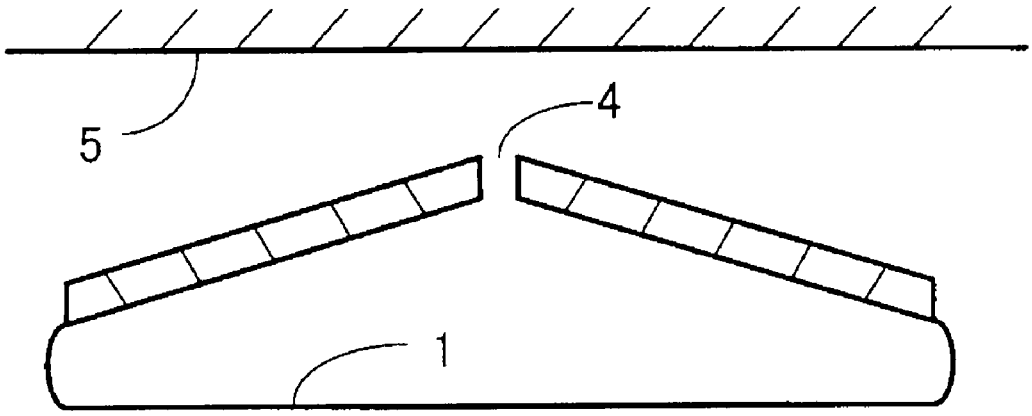
FIG. 8 is a plan view showing an embodiment wherein at least one of the plural sides of a loop shape contains a curved line.

When the original shape is a polygonal or substantially polygonal shape, at least one of the plural sides forming the loop shape may contain a curved line. FIGS. 8 and 9 show such embodiments. In the embodiment shown in FIG. 8, each of the first side, the second and the fourth side contain a curved line, and the loop shape is a substantially quadrangular shape. In the embodiment shown in FIG. 9, each of the first side and the third side contains a curved line, and the loop shape is a substantially quadrangular shape.

In the basic embodiment of the present invention, no conductor other than the antenna conductor 1 is disposed. However, it is preferred in terms of improving antenna gain that the antenna conductor 1 according to the basic embodiment of the present invention have at least one element functioning as a reactance circuit. The reactance circuit may comprise a reactive reactance circuit or an inductive reactance circuit, and the phrase of "functioning as a reactance circuit" means "having the function of improving antenna gain by 0.3 dB or more, in particular 0.5 dB of more.

Figure 10:
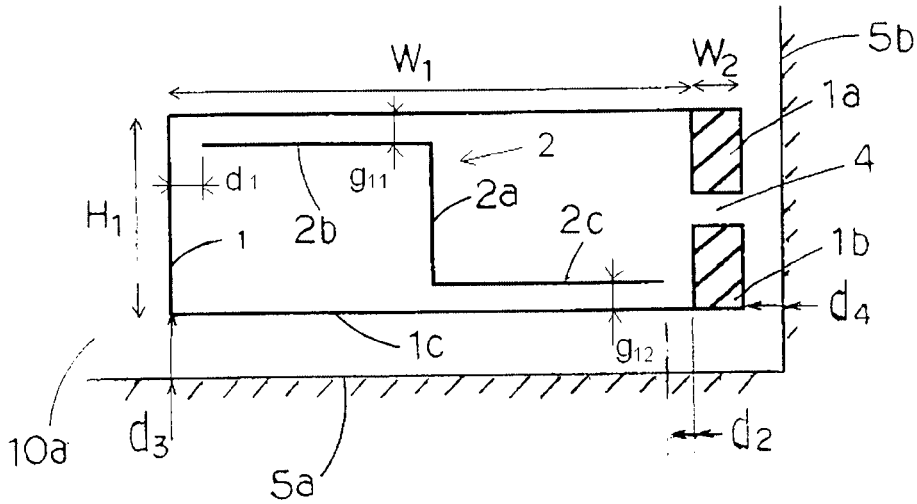
FIG. 10 is a plan view showing an embodiment wherein an island-like conductor is disposed in the embodiment shown in FIG. 3.
Figure 11:
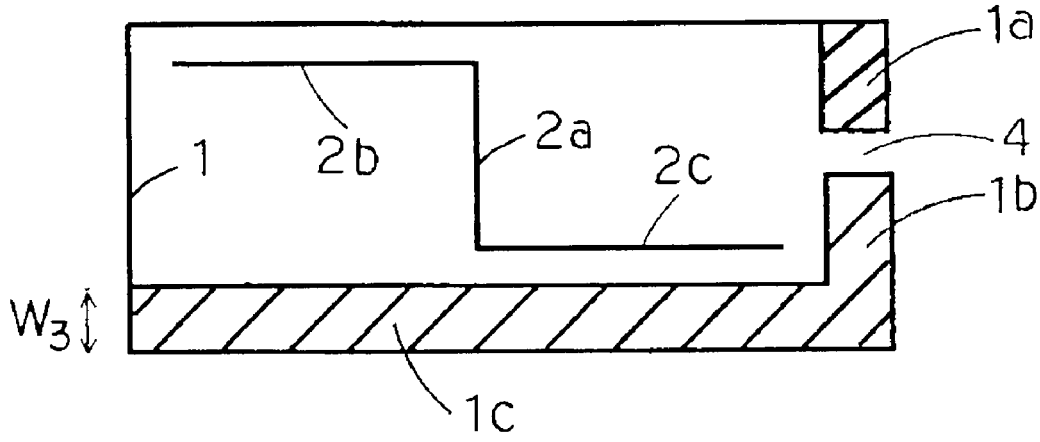
FIG. 11 is a plan view showing an embodiment wherein the embodiment shown in FIG. 10 is partly modified.
Figure 12:
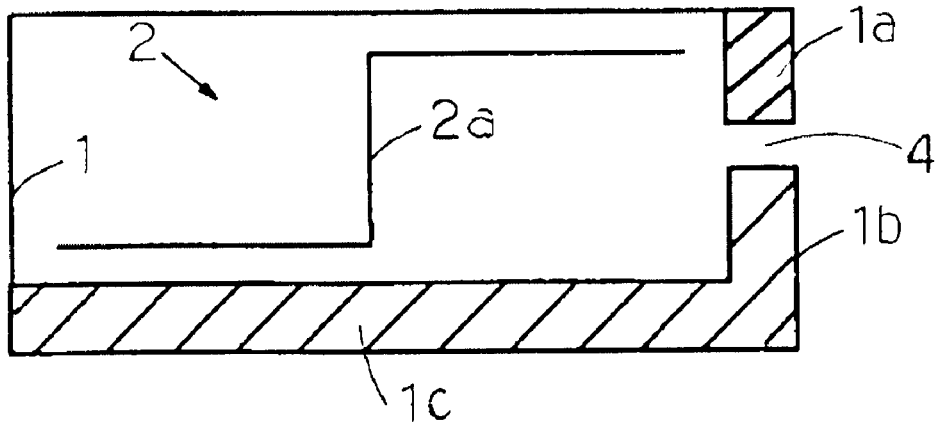
FIG. 12 is a plan view showing an embodiment wherein the island-like conductor in the embodiment shown in FIG. 11 is partly modified.

In each of the embodiments shown in FIGS. 10 to 12, the antenna conductor is combined with an island-like conductor, forming two capacitive coupled portions. Each of the capacitive coupled portions forms an element functioning as such a reactance circuit.

In an example of the element functioning as such a reactance circuit, the window glass sheet has at least one island-like conductor disposed thereon or therein so as not to be connected to the antenna conductor in terms of direct current, the at least one island-like conductor is disposed at a position close to the antenna conductor, and the at least one island-like conductor is disposed inside or outside the loop shape of the antenna conductor.

FIG. 10 is a plan view showing an embodiment wherein the embodiment shown in FIG. 3 is partly modified so that the island-like conductor is disposed inside the loop shape of the antenna conductor, and which is seen from a single side of a rear window glass sheet 10*a* with the high frequency wave glass antenna for an automobile disposed thereon or therein. This explanation is also applicable to each of FIGS. 11 and 12. In each of FIGS. 10 and 11, reference symbol 1*a* designates an upper right side of the antenna conductor 1, reference symbol 1*b* designates a lower right side of the antenna conductor 1, reference symbol 1*c* designates a lower side of the antenna conductor 1, reference symbol 2 designates the is island-like conductor, reference symbol 5*a* designates a lower edge of the vehicle opening, reference symbol 5*b* designates a lower right edge of the vehicle opening (which corresponds to a lower left edge of the vehicle opening in an actual automobile since this figure is seen from the car-interior-side), reference symbol $W_2$ designates each of the width of the upper right side 1*a* and the width of the lower right side 1*b*, reference symbol $W_3$ designees the width of the lower side 1*c*, reference symbol $d_3$ designates the shortest distance between the lower side of the antenna conductor 1 and the lower edge 5*a* of the vehicle opening, and reference symbol $d_4$ designates the shortest distance between the upper right side 1*a* or the lower right side 1*b* and the lower right edge 5*b*.

In FIG. 11, the lower edge 5*a* and the lower right edge 5*b* of the vehicle opening shown in FIG. 10 are omitted (which is also applicable to FIG. 12), and the lower edge and the lower right edge are disposed in the same positions as those shown in FIG. 10. In each of the embodiments shown in FIGS. 10 and 11, the original loop shape that would be formed by the antenna conductor 1 without the discontinuity is a quadrangular or substantially quadrangular shape. The upper right side 1*a* and the lower right side 1*b* form the right side of the antenna conductor 1.

The antenna conductor 1 and the island-like conductor 2 may be disposed in a lower right area of the rear window glass sheet 10*a* (which corresponds to a lower left area in an actual automobile since this figure is seen from the car-interior side). The upper right side 1*a* and the lower right side 1*b* have a greater width than the other sides. In the example shown in FIG. 11, the lower side 1*c* also has a greater width than the remaining sides.

When the sides of the antenna conductor 1 close to the edge of the vehicle opening have a greater width than the other sides as stated above, it is possible to improve antenna gain since a horizontally polarized wave can be well received. The width of the sides of the antenna conductor 1 close to the edge of the vehicle opening preferably ranged from 2 to 50 mm, in particular from 10 to 30 mm. When the width is 2 mm or more, it is possible to improve antenna gain in comparison with a width of narrower than 2 mm. When the width is 50 mm or less, it is possible to make the antenna compact, although the antenna is substantially equal to an antenna having a width of wider than 50 mm in terms of antenna performance.

The reason why the discontinuity 4 is disposed in the right side as one of the lateral sides of the antenna conductor 1 is that it is convenient to mount a feeder cable and it is possible to improve antenna gain. It is preferred that each of the shortest distances $d_3$ and $d_4$ be 50 mm or less. In other words, it is preferred that the shortest distance between the outer peripheral edge of the antenna conductor 1 and the edge of the vehicle opening be 50 mm or less.

When the antenna conductor 1 and the island-like conductor 2 are disposed in a lower left area of the rear window glass sheet 10*a* (which corresponds to a lower right area in an actual automobile since this figure is see from the car-interior side), the antenna conductor 1 and the island-like conductor 2 are disposed in such a way that each of the FIGS. 10 and 11 is seen from the underside. It is preferred from the viewpoint of improving antenna gain by receiving a horizontally polarized wave well that the upper right side 1*a* and the lower right side 1*b* have a greater width than the other sides.

FIG. 12 is a plan view showing an embodiment wherein the island-like conductor 2 in the embodiment shown in FIG. 11 is partly modified and which is seen from a single surface of a rear window glass sheet with the high frequency wave glass antenna for an automobile disposed thereon or therein. The island-like conductor 2 shown in FIG. 12 is formed in the same shape as the one that is seen from the underside of FIG. 11.

In an example of the element functioning as the reactance circuit, the window glass sheet has at least one auxiliary antenna disposed thereon or therein so as to be connected to the antenna conductor in terms of direct current, and the auxiliary antenna has a portion extending toward inside or outside the loop shape of the antenna conductor. The auxiliary antenna will be described later.

In another example of the element functioning as the reactance circuit, at least one of the four sides of the loop shape includes a non-linear portion functioning as the reactance circuit.

When the loop shape is a quadrangular or substantially quadrangular shape other than a square shape, a substantially square shape, a rectangular shape or a substantially rectangular shape in the present invention, it is preferred from the viewpoint of improving antenna gain and ease in mounting that each of the four interior angles of the loop shape range from 70 to 110 degrees, in particular from 80 to 100 degrees.

The antenna conductor according to the present invention, which is shown in each of FIGS. 1 to 12 is accompanied by no auxiliary antenna conductor. However, the present invention is not limited to the embodiments shown in FIGS. 1 to 12. The antenna conductor may be accompanied by an auxiliary antenna conductor formed substantially in a T-character or L-character shape, in a loop shape or in another shape through or not through a connecting conductor for the purpose of impedance matching, phasing, directivity control, reactant circuit functioning or the like.

The antenna conductor may have the center conductor and the outer conductor of a coaxial cable connected to both ends of the discontinuity or portions close to the discontinuity, respectively. The coaxial cable is connected to a receiver. The coaxial cable may be connected directly to the discontinuity by soldering or to the discontinuity through a connector.

There is no limitation to the window glass sheet 10 with the high frequency wave glass antenna according to the present invention disposed thereon or therein. The window glass sheet may be, e.g. a windshield, a rear window, a side window or a roof window.

The antenna conductor may be disposed by printing paste containing conductive metal, such as silver paste, on a glass sheet and baking the printed paste. However, the present invention is not limited to this forming method. A linear member or foil member, which comprises a conductive substance, such as copper, may be bonded on a glass sheet by, e.g. an adhesive.

The antenna conductor may be disposed by forming a plastic film with a conductive layer disposed therein or thereon, on the car-interior-side surface or the car-exterior-side surface of a rear window glass sheet. The antenna conductor may be disposed by forming a flexible circuit board (formed of, e.g. a plastic film) with a conductive layer disposed therein or thereon, on the car-interior-side surface or the car-exterior-side surface of a rear window glass sheet.

In the present invention, a light-shielding coat may be disposed on a glass sheet so that the antenna conductor is partly or entirely disposed on the light-shielding coat. The shielding coat may be formed of a ceramic coat, such as a black ceramic coat. In this case, the window glass sheet can have an excellent design to make the antenna device invisible from the car-exterior-side since the shielding coat shields the portions of the antenna conductor and the other elements disposed thereon when the window glass sheet is seen from the car-exterior-side.

Next, the present invention will be described in reference to examples. It should be noted that the present invention is not limited to these examples, and that variations or modifications are included in the present invention as long as the variations and modifications do not depart from the spirit of the invention.

EXAMPLE 1

It is assumed that a square glass substrate forms a rear window glass sheet. The high frequency wave glass antenna for an automobile is formed by disposing the antenna conductor 1 shown in FIG. 3 at a central portion of the glass substrate on one of the opposed surfaces of the glass substrate, which is supposed to be positioned on the car-interior-side. It is assumed that no other conductor than the antenna conductor 1 is disposed on the glass substrate.

Figure 13:
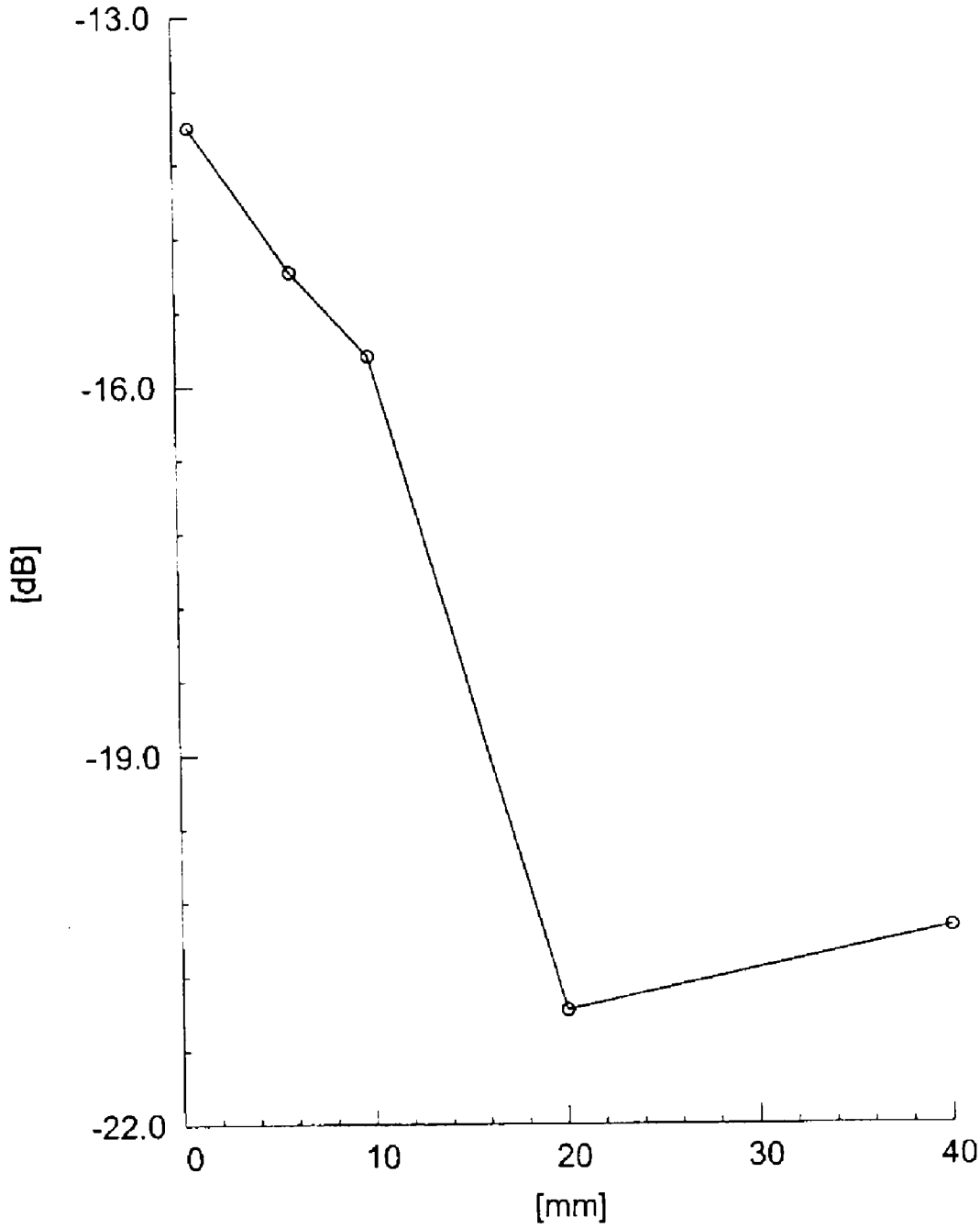
FIG. 13 is a characteristic graph which represents the minimum values of return loss by the vertical axis and conductor widths $W_2$ by the horizontal axis in Example 1.

In accordance with the FDTD method (Finite Difference Time Domain method), the return loss was calculated with the conductor width $W_2$ being changed in a range from 0.8 to 40 mm. The calculation on the return loss was made at every 1 MHz in a frequency band of 470 to 770 MHz. The calculated values of the respective portions are listed below. FIG. 13 shows a characteristic graph which represents the minimum values of the return loss by the vertical axis and the conductor width $W_2$ by the horizontal axis, based on the calculation made when the conductor width $W_2$ was changed in the range of 0.8 to 40 mm. Each of the minimum values of the return loss means the minimum value among the values found by the calculation made at every 1 MHz in the frequency band of 470 to 770 MHz when the conductor width $W_2$ is 0.8 mm for example.

| | |
|---|---|
| Glass substrate | 300 × 300 × 3.10 mm |
| Dielectric constant of glass substrate | 7.0 |
| $H_1$ | 60 mm |
| $W_1$ | 140 mm |
| Gap of discontinuity 4 | 0.5 mm |
| Conductor width of antenna conductor 1 except $W_2$ (conductor width of second to fourth sides) | 0.8 mm |
| Absolute value of smaller one of angles between lower side of loop shape and horizontal surface | 0 degree |
| Length of inner peripheral edge of Loop-shaped conductor | 400 mm |

EXAMPLE 2

Figure 14:
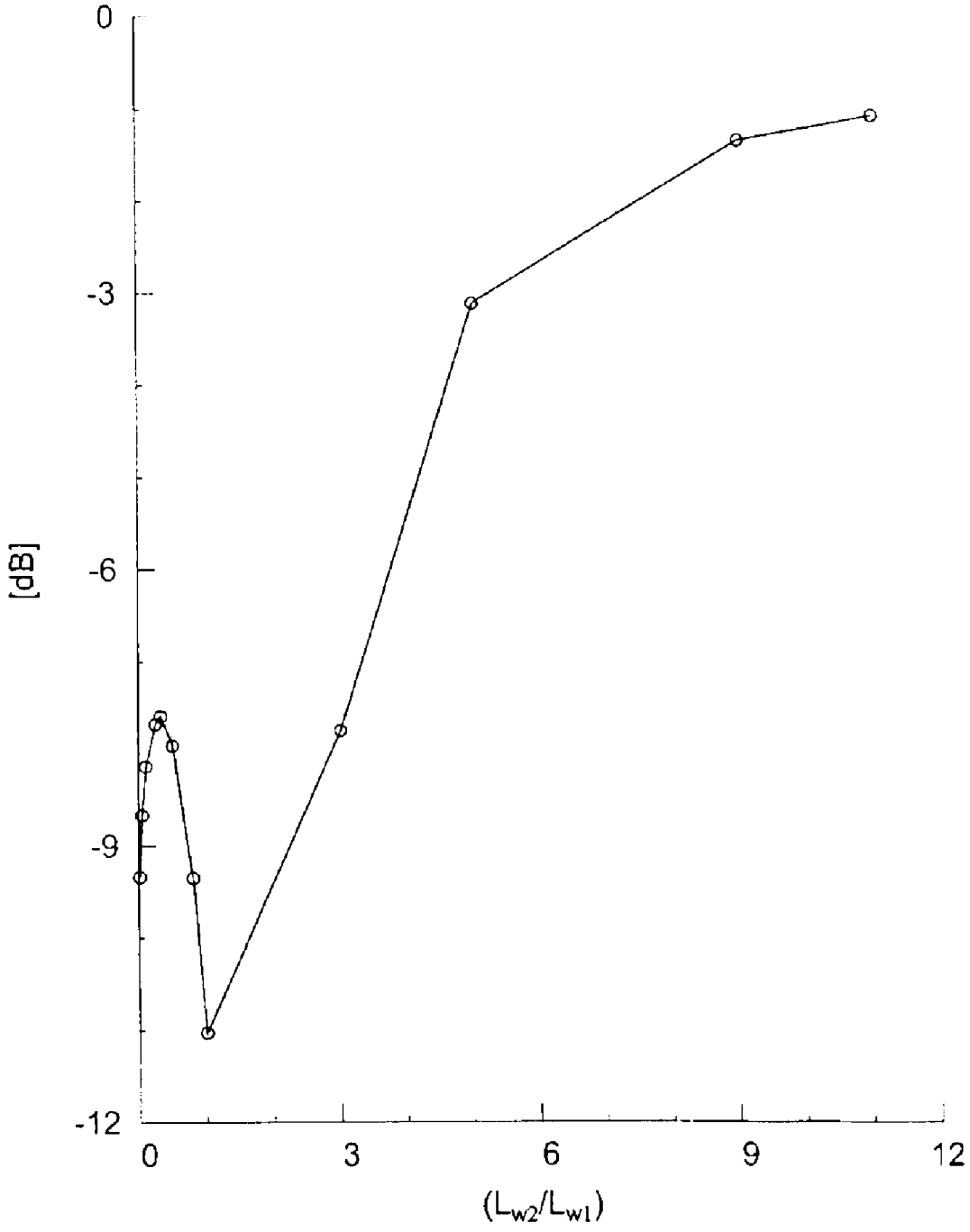
FIG. 14 is a characteristic graph which represents the minimum values of the return loss by the vertical axis and ($L_{W2}/L_{W1}$) by the horizontal axis in Example 2.

The return loss was calculated with ($L_{W2}/L_{W1}$) being changed (in other words, with ($W_1/H_1$) being changed) under the same conditions as those in Example 1 except for the conditions listed below. The calculation method was the same as that in Example 1. ($L_{W2}/L_{W1}$) was calculated at twelve points of 0.01, 0.05, 0.11, 0.25, 0.33, 0.50, 0.80, 1.00, 3.00, 5.00, 9.00 and 11.00. FIG. 14 shows a characteristic graph which represents the minimum values of the return loss by the vertical axis and ($L_{W2}/L_{W1}$) by the horizontal axis.

Figure 15:
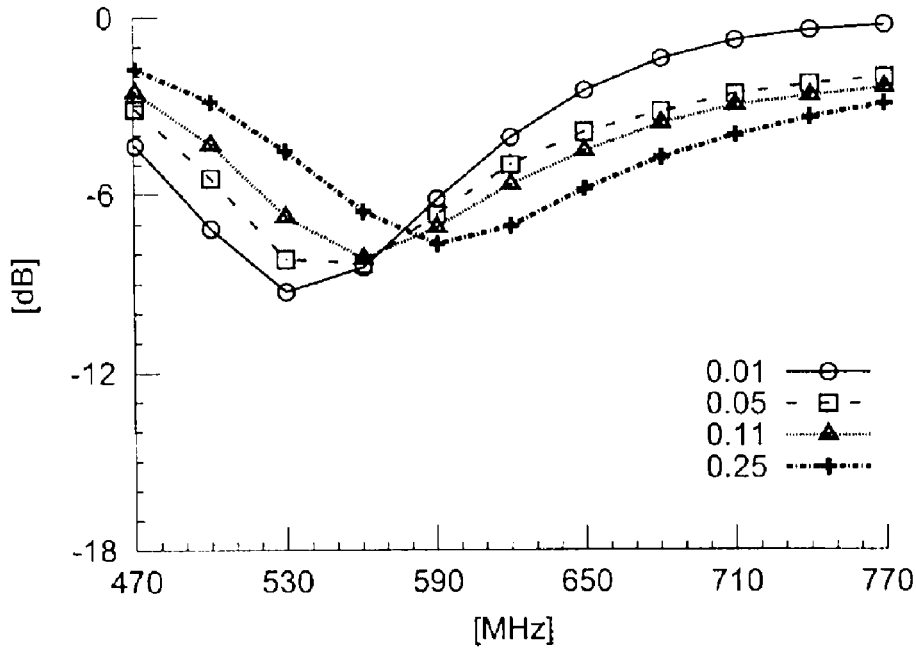
FIG. 15 is a graph showing return loss-frequency characteristics in Example 2.
Figure 16:
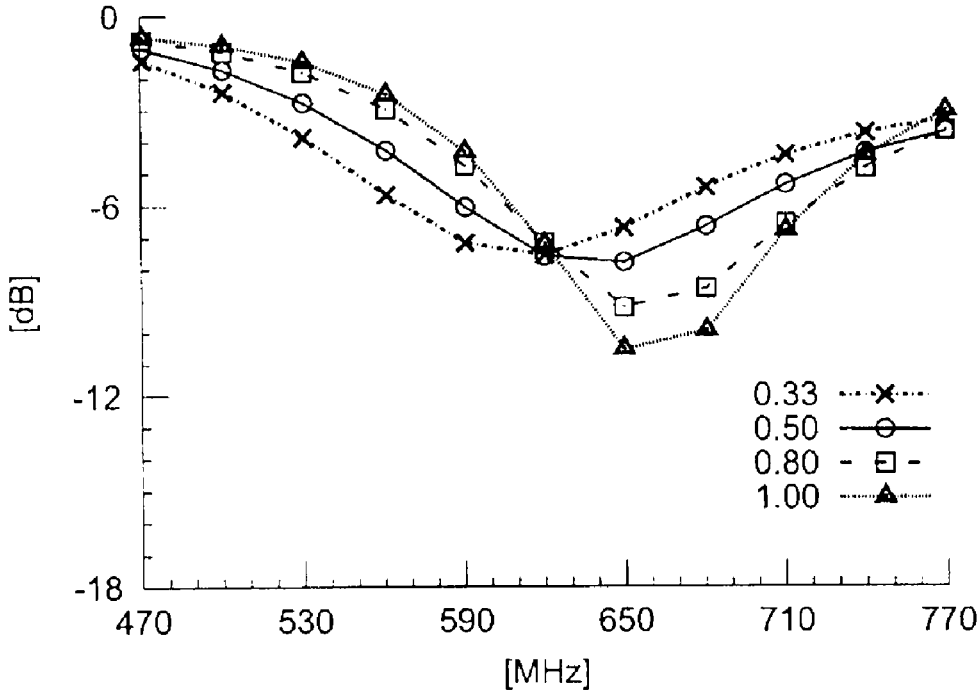
FIG. 16 is a graph showing return loss-frequency characteristics in Example 2, provided that the values indicating ($L_{W2}/L_{W1}$) are different from the ones shown in FIG. 15.
Figure 17:
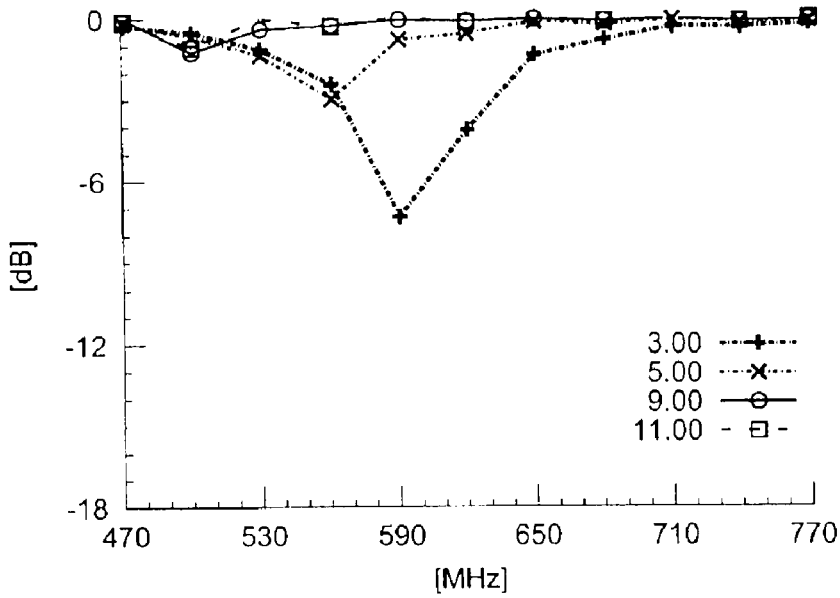
FIG. 17 is a graph showing return loss-frequency characteristics in Example 2, provided that the values indicating ($L_{W2}/L_{W1}$) are different from the ones shown in FIGS. 15 and 16.

FIGS. 15 to 17, based on which FIG. 14 is prepared, show return loss-frequency characteristics for respective values of ($L_{W2}/L_{W1}$). FIG. 15 shows 0.01, 0.05, 0.11 and 0.25 as the values of ($L_{W2}/L_{W1}$). FIG. 16 shows 0.33, 0.50, 0.80 and 1.00 as the values of ($L_{W2}/L_{W1}$). FIG. 17 shows 3.00, 5.00, 9.00 and 11.00 as the values of ($L_{W2}/L_{W1}$).

| | |
|---|---|
| $W_2$ | 20 mm |
| Gap of discontinuity 4 | 5 mm |

EXAMPLE 3

The return loss was calculated at two points of 3.00 is and 11.00 for ($L_{W2}/L_{W1}$) under the same conditions as those in Example 2 except that the discontinuity 4 has a gap of 1 mm.

When ($L_{W2}/L_{W1}$) was 3.00, the return low had a minimum value of −7.75 dB in both of Example 2 and Example 3. When ($L_{W2}/L_{W1}$) was 11.00, the return loss had a minimum value of −1.07 dB in both of Example 2 and Example 3. This reveals that there is no change in the value of the return loss in both of a case where the discontinuity 4 has a gap of 1 mm and a case where the discontinuity 4 has a gap of 5 mm.

EXAMPLE 4

The measurement was made, disposing antenna conductors 1 and 2 as shown in FIG. 10 (seen from a car-interior side) in a lower left area of a rear window glass sheet including a defogger (a position corresponding to a lower right area in FIG. 10 and under the defogger). The rear window glass sheet was inclined at an angle of 26 degrees with respect to the horizontal direction.

The antenna gain for a horizontally polarized wave is represented by antenna gain average values (every 1°) within −90° to +90° in the horizontal direction (automobile backside) when the center of a rear portion of the automobile is set at 0 (zero) degree, the right direction of the automobile is set at +90 degree and the center of a front portion of the automobile is set at +180 degree. This definition of the antenna gain is also applicable to the characteristic graphs stated below. The measurement was made at every 3 MHz in a frequency range of 470 to 770 MHz.

Figure 18:
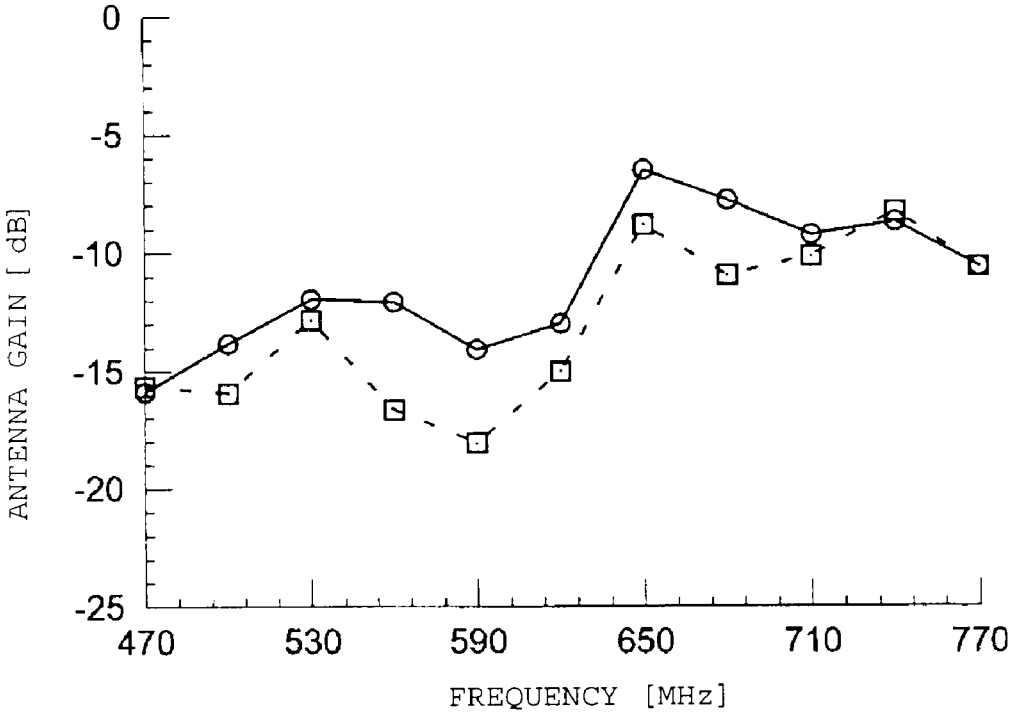
FIG. 18 is a graph showing return loss-frequency characteristics in Examples 4 and 5.

The characteristic graph of antenna gain-frequency is depicted in a dotted line in FIG. 18. The numerical values of the respective portions are listed below.

| | |
|---|---|
| Thickness of rear window glass sheet | 3.1 mm |
| $H_1$ | 50 mm |
| $W_1$ | 135 mm |
| $W_2$ | 15 mm |
| Conductor length of left-hand element 2b | 57.5 mm |
| Conductor length of connecting element 2a | 30.0 mm |
| Conductor length of right-hand element 2c | 57.5 mm |
| $g_{11}$ (as well as $g_{12}$) | 10 mm |
| $d_1$ (as well as $d_2$) | 10 mm |
| $d_3$ | 10 mm |
| $d_4$ | 5 mm |
| Gap of discontinuity 4 | 0.5 mm |
| Conductor width of first antenna conductor 1 (except for $W_2$) | 0.8 mm |
| Conductor width of second antenna conductor 2 (except for $W_2$) | 0.8 mm |

EXAMPLE 5

The measurement was made with antenna conductors 1 and 2 as shown in FIG. 11 (seen from a car interior side) being disposed in a lower left area of a rear window is glass sheet. The measurement was made under the same conditions as those in Example 4 except that the value of $W_3$ was changed from 0.8 mm (Example 4) to 15 mm. The characteristic graph of antenna gain-frequency is depicted in a solid line in FIG. 18.

EXAMPLE 6

Figure 19:
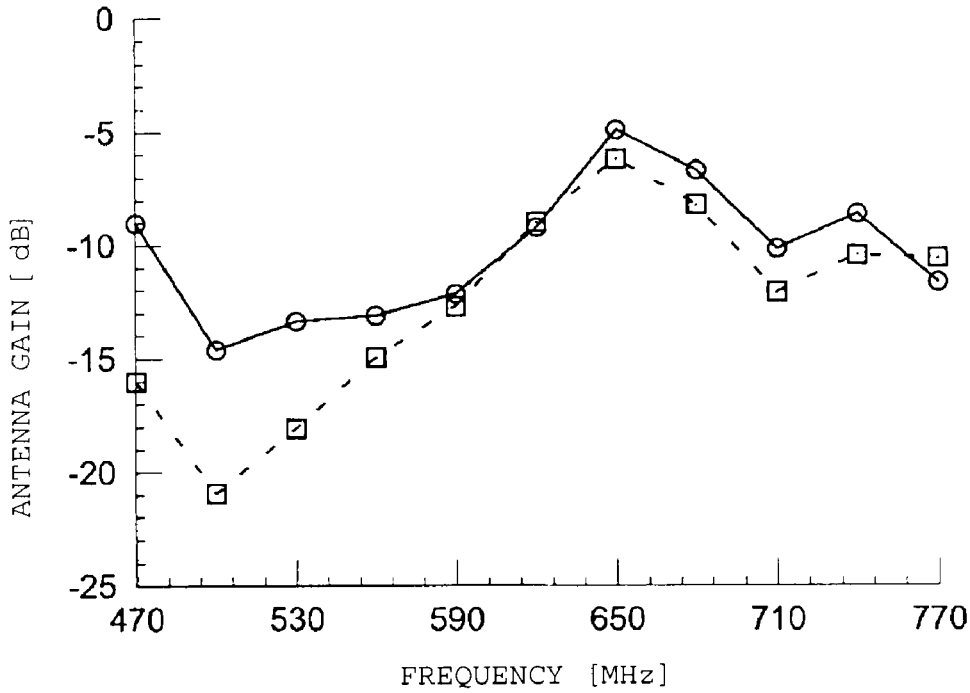
FIG. 19 is a graph showing return loss-frequency characteristics in Examples 6 and 7.
Figure 20:
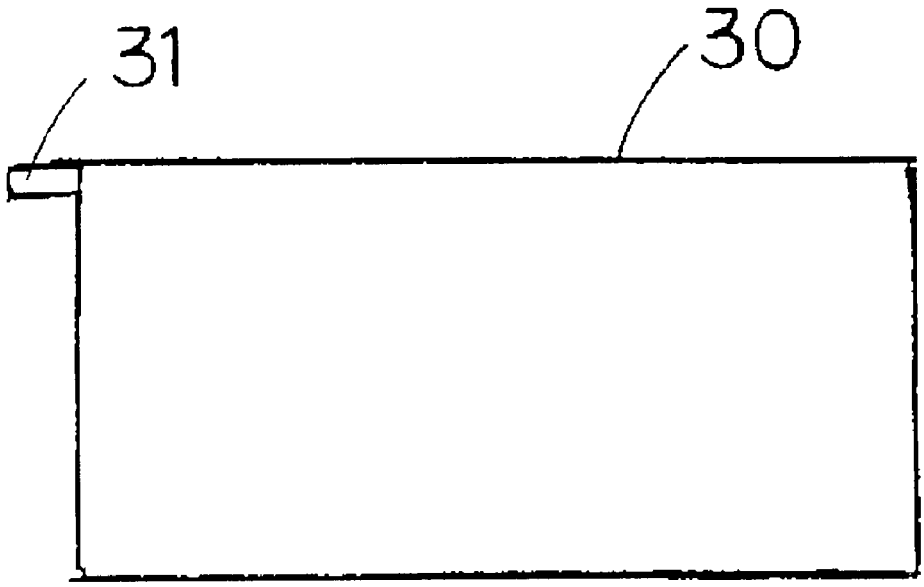
FIG. 20 is a plan view of a prior art high frequency wave glass antenna for an automobile.

The measurement was made with antenna conductors 1 and 2 as shown in FIG. 11 (seen from a car-interior side) being disposed in a lower left area of a rear window glass sheet. The specifications for this example, including the numerical values of the respective portions, were the same as those in Example 5 unless otherwise specified. The numerical values of the respective portions are listed below. The characteristic graph of antenna grain-frequency is depicted in a solid line in FIG. 19.

| | |
|---|---|
| $H_1$ | 56 mm |
| $W_1$ | 129 mm |
| Conductor length of left-hand element 2b | 54.5 mm |
| Conductor length of connecting element 2a | 36.0 mm |
| Conductor length of right-hand element 2c | 54.5 mm |

EXAMPLE 7

The measurement was made with antenna conductors 1 and 2 as shown in FIG. 12 (seen from a car-interior side) being disposed in a lower left area of a rear window glass sheet. The specifications for this example were the same those in Example 6 except that the island-like conductor 2 was formed in the reverse shape in a right-to-left direction. In other words, when it is assumed that no discontinuity 4 is disposed, the positional relationship of the inner peripheral edge of the antenna conductor 1 and the island-like conductor 2 is the same as a case where the positional relationship is seen from the underside of FIG. 11 in Example 6. The characteristic graph of antenna gain-frequency is depicted in a dotted line in FIG. 19.

The present invention is applicable to a glass antenna for an automobile, which receives a digital terrestrial television broadcast, a UHF band analog television broadcast, a US digital television broadcast, an EU digital television broadcast or a Chinese digital television broadcast. The present invention is also applicable to the Japanese FM broadcast band (76 to 90 MHz), the US FM broadcast band (88 to 108 MHz), the television VHF band (90 to 108 MHz and 170 to 222 MHz), the 800 MHz band for automobile telephones (810 to 960 MHz), the 1.5 GHz band for automobile telephones (1.429 to 1.501 GHz), the UHF band (300 MHz to 3 GHz), the GPS (Global Positioning System), the GPS signal for artificial satellites (1,575.42 MHz) and the VICS (trademark representing Vehicle Information and Communication System: 2.5 GHz).

Further, the present invention is also applicable to the ETC communication (Electronic Toll Collection System: non-stop automatic fare collection system, transmit frequency of roadside wireless equipment (5.795 GHz or 5.805 GHz), reception frequency of roadside wireless equipment (5.835 GHz or 5.845 GHz)), the DSRC (Dedicated Short Range Communication in the 915 MHz band, the 5.8 GHz band and the 60 GHz band), communication using a microwave (1 GHz to 3 THz), communication using millimeter wave (30 to 300 GHz), communication for the automobile keyless entry system (300 to 450 MHz), and communication for the SDARS (Satellite Digital Audio Radio Service (2.6 GHz)).

The entire disclosures of Japanese Patent Application No. 2007-098783 filed on Apr. 4, 2007, Japanese Patent Application No. 2007-231401 filed on Sep. 6, 2007 and Japanese Patent Application No. 2006-246761 filed on Sep. 12, 2006 including specifications, claims, drawings and summaries are incorporated herein by reference in their entireties.

What is claimed is:

1. A high frequency wave glass antenna for an automobile, comprising:

an antenna conductor adapted to be disposed in or on an automobile window glass sheet, the antenna conductor being formed in such a loop shape that a portion of the loop shape is cut out by a length to dispose a discontinuity;

both ends of the discontinuity or portions of the antenna conductor close to the discontinuity serving as feeding points; and a portion of the antenna conductor with the discontinuity disposed therein or a portion of the antenna conductor close to the discontinuity having a conductor width of 8.0 to 40 mm, wherein a loop shape that is originally formed by the antenna conductor when it is assumed that no discontinuity is disposed is a polygonal or substantially polygonal shape; and wherein when the loop shape comprises a plurality of sides, and when one of the sides is called a first side, the discontinuity is disposed in the first side, one of corners of both ends of the first side, or a side close to the one corner, and the first side has a conductor width of 8.0 to 40 mm.

2. The glass antenna according to claim 1, wherein a loop shape that is originally formed by the antenna conductor when it is assumed that no discontinuity is disposed is a square or substantially square shape; and wherein in a case where one of the four sides of the loop shape is called a first side, and where the remaining sides are respectively called a second side, a third side and a fourth side in a clockwise direction;

when the first side has the same length as the third side in terms of inner peripheral edge, the length is called $L_{w1}$, When the first side has a different length from the third side in terms of inner peripheral edge, a greater length is called $L_{w1}$;

When the second side has the same length as the fourth side in terms of inner peripheral edge, the length is called $L_{w2}$; and when the second side has a different length from the fourth side in terms of inner peripheral edge, a greater length is called $L_{w2}$;

$(L_{w2}/L_{w1})$ is 9 or less; and the first side and the third side have a shortest distance of 0.2 mm or more therebetween.

3. The glass antenna according to claim 1, wherein when the discontinuity is configured as if the discontinuity is disposed by being cut out of a portion of the first side, 70% or more of a length of the first side except for the discontinuity has a conductor width of 8.0 to 40 mm; and wherein when the discontinuity is configured as if the discontinuity is disposed without being cut out of a portion of the first side, 70% or more of a length of the first side has a conductor width of 8.0 to 40 mm.

4. The glass antenna according to claim 1, further comprising at least one auxiliary antenna conductor adapted to be disposed on or in the window glass sheet so as to be connected to the antenna conductor in terms of direct current;

wherein the auxiliary antenna has a portion extending toward inside or outside the loop shape of the antenna conductor.

5. The glass antenna according to claim 1, wherein at least one of the sides of the loop shape contains a curved line.

6. The glass antenna according to claim 1, wherein at least one side of the loop shape other than the first side has a conductor width of 0.2 to 40 mm.

7. The glass antenna according to claim 1, wherein when the loop shape is a quadrangular or substantially quadrangular shape other than a square shape, a substantially square shape, a rectangular shape or a substantially rectangular shape, four interior angles of the loop shape range from 70 to 110 degrees, respectively.

8. The glass antenna according to claim 1, wherein the antenna conductor is configured to have such a shape and dimensions to be adapted to receive a digital television broadcast.

9. The glass antenna according to claim 1, wherein a received radio wave has a frequency existing from 470 to 770 MHz.

10. The glass antenna according to claim 1, wherein a received radio wave has a frequency existing from 698 to 806 MHz.

11. The glass antenna according to claim 1, wherein the antenna conductor is disposed on or in a plastic film, and the plastic film is adapted to be disposed on or in the window glass sheet.

12. The glass antenna according to claim 11, wherein the plastic film comprises a flexible circuit board.

13. A window glass sheet for an automobile, including the antenna conductor defined in claim 1.

14. The glass antenna according to claim 1, wherein the antenna conductor has at least one element disposed therein so as to function as a reactance circuit.

15. The glass antenna according to claim 1, further comprising at least one island-like conductor adapted to be disposed on or in the window glass sheet so as not to be connected to the antenna conductor in terms of direct current;

wherein the at least one island-like conductor is disposed at a position close to the antenna conductor, and the at least one island-like conductor is disposed inside or outside the loop shape of the antenna conductor.

16. The glass antenna according to claim 1, wherein when it is assumed that a radio wave for communication has a wavelength of $\lambda_0$ in the air and that glass has a shortening coefficient of wavelength of k, when the formula of $\lambda_{g=\lambda 0}\cdot k$ is established;

the loop shape that is originally formed by the antenna conductor when it is assumed that no discontinuity is disposed has an inner peripheral edge having a length of $0.79\lambda_g$ to $2.50\lambda_g$.

17. The glass antenna according to claim 1, wherein the discontinuity has a shortest gap of 0.5 to 20 mm.

18. A high frequency wave glass antenna for an automobile, comprising:

an antenna conductor adapted to be disposed in or on an automobile window glass sheet, the antenna conductor being formed in such a loop shape that a portion of the loop shape is cut out by a length to dispose a discontinuity;

both ends of the discontinuity or portions of the antenna conductor close to the discontinuity serving as feeding points; and a portion of the antenna conductor with the discontinuity disposed therein or a portion of the antenna conductor close to the discontinuity having a conductor width of 8.0 to 40 mm, wherein a loop shape that is originally formed by the antenna conductor when it is assumed that no discontinuity is disposed is a square or substantially square shape extending in a longitudinal direction;

wherein in a case where two shorter sides of the four sides of the loop shape are called lateral sides, the discontinuity is disposed in one of the two lateral sides, at the corner of the loop shape or a side of the loop shape close to the corner;

when the lateral side of the loop shape with the discontinuity disposed therein, or the lateral side of the loop shape close to the discontinuity is called a first side, and the remaining sides are called a second side, a third side and a fourth side in a clockwise direction;

the first side has a conductor width of 8.0 to 40 mm.

19. The glass antenna according to claim 18, wherein in a case where the four sides of the loop shape contain only one longest side, the antenna conductor is disposed so that a smaller one of angles included between the longitudinal direction of an inner peripheral edge of the longest side and a horizontal surface has an absolute value of 0 to 30 degrees;

wherein in case where the four sides of the loop shape contain two longest sides, when one of the longest sides is disposed in a lower position and called a lower side, the antenna conductor is disposed so that a smaller one of angles included between the longitudinal direction of an inner peripheral edge of the lower side and a horizontal surface has an absolute value of 0 to 30 degrees.

20. The glass antenna according to claim 18, further comprising at least one island-like conductor adapted to be disposed on or in the window glass sheet so as not to be connected to the antenna conductor in terms of direct current;

wherein the at least one island-like conductor is disposed at a position close to the antenna conductor, and the at least one island-like conductor is disposed inside or outside the loop shape of the antenna conductor.

21. The glass antenna according to claim 18, wherein at least one of the four sides of the loop shape includes a non-linear portion functioning as a reactance circuit.

22. The glass antenna according to claim 18, wherein the inner peripheral edge of the antenna conductor is formed so as to have a maximum vertical width $H_1$ and a maximum transverse width $W_1$ satisfying the formula of $(W_1/H_1)=1.2$ to 9.

23. The glass antenna according to claim 18, wherein the discontinuity has a shortest gap of 0.5 to 20 mm.

24. A high frequency wave glass antenna for an automobile, comprising:

an antenna conductor adapted to be disposed in or on an automobile window glass sheet, the antenna conductor being formed in such a loop shape that a portion of the loop shape is cut out by a length to dispose a discontinuity;

both ends of the discontinuity or portions of the antenna conductor close to the discontinuity serving as feeding points; and a portion of the antenna conductor with the discontinuity disposed therein or a portion of the antenna conductor close to the discontinuity having a conductor width of 8.0 to 40 mm, wherein the antenna conductor has at least one element disposed therein so as to function as a reactance circuit.

25. A high frequency wave glass antenna for an automobile, comprising:

an antenna conductor adapted to be disposed in or on an automobile window glass sheet, the antenna conductor being formed in such a loop shape that a portion of the loop shape is cut out by a length to dispose a discontinuity:

both ends of the discontinuity or portions of the antenna conductor close to the discontinuity serving as feeding points; and a portion of the antenna conductor with the discontinuity disposed therein or a portion of the antenna conductor close to the discontinuity having a conductor width of 8.0 to 40 mm, wherein when it is assumed that a radio wave for communication has a wavelength of $\lambda_0$ in the air and that glass has a shortening coefficient of wavelength of k, when the formula of $\lambda_g=\lambda_0 \cdot k$ is established;

the loop shape that is originally formed by the antenna conductor when it is assumed that no discontinuity is disposed has an inner peripheral edge having a length of $0.79\lambda_g$ to $2.50\lambda_g$.

* * * * *